US005115882A

United States Patent [19]

Woody

[11] Patent Number: 5,115,882

[45] Date of Patent: May 26, 1992

[54] OMNIDIRECTIONAL DISPERSION SYSTEM FOR MULTIWAY LOUDSPEAKERS

[76] Inventor: D. Grier Woody, 420 Summerour St., Norcross, Ga. 30071

[21] Appl. No.: 330,052

[22] Filed: Mar. 29, 1989

[51] Int. Cl.[5] ..... H05K 5/00; H04R 25/00

[52] U.S. Cl. ..... 181/144; 181/153; 181/155; 381/160; 381/184; 381/205

[58] Field of Search ..... 181/144-147, 181/153-156; 381/90, 160, 182, 184, 186, 205

[56] References Cited

U.S. PATENT DOCUMENTS

| | | | |
|---|---|---|---|
| 2,820,525 | 1/1958 | Fountain et al. | 181/187 |
| 3,326,321 | 6/1967 | Valuch | 181/144 |
| 3,371,742 | 3/1968 | Norton et al. | 181/153 |
| 3,424,873 | 1/1969 | Walsh | 381/158 |
| 3,500,953 | 3/1970 | Lahti | 181/153 X |
| 3,816,672 | 6/1974 | Gefvert et al. | 181/144 X |
| 4,200,170 | 4/1980 | Williams, Jr. | 181/155 |
| 4,348,549 | 9/1982 | Berlant | 181/155 X |
| 4,574,906 | 3/1986 | White | 181/145 |

FOREIGN PATENT DOCUMENTS

| | | | |
|---|---|---|---|
| 143597 | 9/1951 | Australia . | |
| 2325603 | 12/1974 | Fed. Rep. of Germany | 181/153 X |
| 788943 | 1/1958 | United Kingdom . | |

*Primary Examiner*—Russell E. Adams
*Assistant Examiner*—Jae N. Noh

[57] ABSTRACT

A sound dispersing system using two or more vertically facing drivers in substantially coaxial alignment on a vertical axis. The drivers face conic reflectors which reflect sound radially over 360 degrees with substantial dispersion in vertical planes that include the vertical axis. Mounting means for drivers and reflectors are spaced vertically apart so that the vertical separation of the effective acoustic centers does not exceed industry standards for coherent sound above and below the horizontal plane equidistant between two drivers assigned adjacent bands of sound frequencies. The spacial relationship of the drivers and their mounting means cooperates with the slope of the reflectors insuring that sound energy is reflected directly into ambient air without reflection back upon driver diaphragms without encoutering obstructions in the soundpath from drivers to ambient air, without high frequency energy loss due to internal reflections and without high frequency standing wave activity between interior parallel surfaces. The dispersion system features means for adjusting time and phase alignment of the drivers in order to compensate for time and phase characteristics of different drivers and crossover networks. The dispersion system can exist as an independent structural unit which can be adapted to otherwise conventional loudspeaker systems as an inexpensive way of adding the enhancements of point-source omnidirectional sound to existing systems for enhancing non-directional frequencies.

20 Claims, 2 Drawing Sheets

OMNIDIRECTIONAL DISPERSION SYSTEM FOR MULTIWAY LOUDSPEAKERS

FIELD OF THE INVENTION

This invention relates to loudspeakers and particularly to systems for dispersing sound radially 360 degrees about a vertical axis. Specifically, this invention is an improved system for dispersing midrange and high frequency sound waves, otherwise referred to as directional sound waves, radially over 360 degrees about a vertical axis using a plurality of conventional drivers which reproduce adjacent bands of the audio spectrum and which face conic dispersion surfaces to obtain the desired radial dispersion.

BACKGROUND OF THE INVENTION

The quest for loudspeakers that more perfectly reproduce recorded sound has intensified since the introduction of recording techniques that eliminate background noise and restore the dynamic range of the original performance.

One theoretical model of "perfect" sound reproduction is that produced by a pulsating sphere which radiates sound outwardly in all directions away from the point at the center of the spherical "loudspeaker". The rays of sound waves would diverge outwardly and interferences between sound waves would thereby be eliminated. Practitioners who strive to approach this ideal refer to it as "point-source omnidirectional" sound dispersion.

In the 1940's, before the advent of stereo sound, a method of dispersing sound was employed which remains the closest approach to point-source omnidirectional sound dispersion yet achieved. A conic reflecting surface was positioned before a vertically-firing driver in a facing relationship. Sound waves were reflected outwardly, away from the central vertical axis of the system, radially 360 degrees in horizontal planes. The natural dispersion of the driver about its firing axis caused sound waves to strike the conic reflecting surface at decreasing angles of incidence as the points of striking approached the base of the reflector. The corresponding decrease in the angles of reflection off the conic surface imparted a vertical dispersion of the sound in planes that include the vertical axis of the system. Thus all directional sound waves were reflected away from a series of points on and about the vertical axis of the system in the region of the geometric height of the conic reflector and, for all practical purposes, point-source omnidirectional sound was achieved.

But all efforts to adapt the above method to multiway loudspeakers have failed in terms of modern standards for low distortion sound reproduction. Recent offerings, ignoring acoustical principles, introduce various forms of distortion. None has proved successful commercially. As a consequence, the enhancements of point-source omnidirectional sound and its enhancements of sound reproduction in stereo applications has been unavailable to the audio enthusiast. The present invention addresses this need and resolves the problem using relatively inexpensive, conventional dynamic drivers.

PRIOR ART

Heretofore, loudspeaker dispersing systems with a plurality of conventional drivers assigned adjacent bands of audio frequencies and using conic dispersion surfaces to disperse sound radially about a vertical axis have shown two major types of faulty acoustical designs:

One major type of design flaw found in prior art is that which prevents directional sound waves from being radiated directly into ambient air. All known examples of prior art show a combination of several of the following conditions which disrupt the proper reflection of sound waves directly into ambient air and thereby cause distortion:

reflectors that do not completely cover the planar surfaces on which the reflectors are mounted. Sound waves radiating directly off driver diaphagms and striking these exposed surfaces are reflected obliquely back across, or converge with, sound waves dispersed by the conic reflecting surfaces. Sound waves striking conic reflecting surfaces near their bases and being reflected at relatively small agles can also strike these exposed surfaces and be reflected back across, or converge with, other sound waves. Because of the differences in distances travelled the overlapping or obliquely converging sound waves can be out of phase and cause sound wave interferences which, by intensifying some frequencies and canceling others, introduce serious distortions in the reproduction of sound. Also, these exposed planar surfaces cooperate with the surfaces supporting drivers to establish parallel planar surfaces across the soundpath of sound waves dispersed by the reflecting surfaces, a condition conductive to standing wave activity which also causes reinforcement of some frequencies and cancellations of others.

conic reflecting surfaces of reflectors having slopes that reflect sound waves back upon the surfaces drivers are mounted on. This causes additional reflections back across sound waves emitting into ambient air with the problems described above.

reflecting surfaces having slopes such that sound is reflected back upon driver diaphragms. Sound energy absorbed by a driver diaphragm alters the pitch and waveform of the sound waves radiating off the diaphragm. A serious coloration of acoustical output is introduced. This is particularly noticeable throughout the midrange frequencies, the predominate tones in most music and the human voice.

conic reflectors with apexes extending into the conic opening of a driver diaphragm. This has two major detrimental effects: upper frequency sound energy is reflected back on driver diaphragms as above; and an irregular horn-like annular passageway enclosing the soundpath of emitting soundwaves is created. Any partially enclosed interior space having irregular sides cause detrimental interractions between midrange and high frequency sound waves.

reflecting surfaces of reflectors defining steeply concave slopes. A steeply concave reflecting surface introduces three major problems: high frequency energy deteriorates as these sound waves with very short eave lengths undergo several energy absorbing reflections when maneuvering concave surfaces; directional sound waves are focused along closely parallel, and/or converging lines, promoting interferences with detrimental effects already discussed; and dispersion of directional sound waves in vertical planes is significantly restricted, the steeply concave reflecting surface significantly reducing or eliminating the progressive decrease in angles of incidence and reflection as points of reflection approach the base of the reflector.

The other major type of faulty acoustical design found in prior art involves the respective distances from the acoustic center of any two adjacent drivers to the ear of a listener. When there is a discrepency in the two distances the sound from one driver reaches the ear of a listener before the sound from the other. Time-wise, the drivers are said to be incoherent. Phase-wise, the drivers will be out of phase over a range of frequencies. Both the time and phasal discrepencies result in a loss of clarity in the reproduction of sound sources, particularly those musical instruments and voices having characteristic tones and overtones spanning the frequencies of midrange and high frequency drivers. Many of the subtle nuances of tone and timbre which distinguish various musical instruments and the human voice can be lost. Transients are "smeared", masking delicate harmonics and the subdued ambient content of the original sound. Stereo imaging is vague and often shifting, particularly with regard to the placement of individual instruments and performers within the perceived soundstage.

It is commonly recognized that one technique employed in the design of frontal-firing louspeakers to overcome time and phase incoherencies as much as possible is to position the midrange and high frequency drivers as close together as possible in a vertical alignment on the speaker baffle of the loudspeaker enclosure. It is not uncommon for the mounting flanges of the two drivers to actually touch each other. By doing this the vertical separation of the acoustic centers of the drivers is made as small as possible.

The above practice is followed because the upper and lower "sides" of a "listening window" over which the sound from the two drivers is reasonably coherent is a function of the vertical separation of the acoustic centers of proximate midrage and high frequency drivers. The vertical spread of coherent sound over which the listener connot detect the time differential is inversely proportional to the vertical separation of the two acoustic centers. That is say, if the vertical separation can be halved the vertical dimension of the "window" is doubled. Thus, positioning the drivers as close together as possible maximizes the opportunity to hear coherent sound in the listening area.

Since the acoustic center of a driver is located at the geometric center of the driver diaphragm, the vertical separation of the acoustic centers of the midrange and high frequency drivers of a well designed frontal-firing loudspeaker system will approximate or will equal one-half the combined distance across the mounting flanges of the two drivers. There are no known examples of prior art wherein the corresponding vertical separation of acoustic centers meets this standard.

In prior art and in the present invention the factors which determine the vertical separation of acoustic centers are different from the corresponding factors in frontal-firing systems. Several explanations are in order for the problems of vertical separation of acoustic centers to be understood, keeping in mind that the position of the acoustic center of each vertically firing driver remains critical. The distance between the acoustic center of one driver in the vertical alignment and the apex of a facing reflector must be essentially the same as the distance between the acoustic center of an adjacent driver in the alignment and the apex of the reflector facing the adjacent driver or time alignment would be disrupted.

However, the acoustic center of each driver does not constitute an acoustic center of the dispersion system. In omnidirectional dispersion about a central vertical axis by conic reflectors the acoustic centers of the system are associated with the reflectors which direct the sound toward the listener.

Actually, there are numerous acoustic centers associated with each reflector of a dispersing system and the method of locating them is illustrated in the attached drawings and explained in a later section describing them. For our present purposes it is sufficient to adopt the convention of referring to the median point of a spacial array of points approximately on the geometric height of a conic reflector as the *effective* acoustic center of a conic reflector.

As already suggested, there are no known examples of prior art showing a vertical separation of effective acoustic centers of adjacent reflectors that approximates one-half the combined distance across the mounting flanges of two adjacent drivers. The vertical separations of these centers in known examples of prior art range from approximately 1.5 to more than 5.0 times this distance. This suggests that the the vertical spread of the "listening window" produced by prior art is reduced to two-thirds to less than one-fifth of the "window" produced by the better frontal-firing loudspeaker systems which presently establish the standards of the industry.

OBJECTS OF THE INVENTION

The first object of this invention is to advance the state of the art of point-source omnidirectional dispersion systems for multiway loudspeakers. The objective is to obtain omnidirectional sound dispersion of directional frequencies which conforms as closely as possible to the ideal of all sound waves radiating outwardly from a single point in space, each ray of each sound wave diverging from its neighbors so that interactions between sound waves are eliminated or minimized to the point of inaudibility. The method of achieving this objective is very direct, the elimination of the faulty acoustical design features of prior art.

Another object of the invention is to make the advantages of point-source omnidirectional sound systems of high quality available to the public at affordable prices, using drivers of conventional dynamic design.

Still another object of the invention is to make the above dispersion system available with means that permit fine adjustments of the time and phase alignment of the drivers so that discrepencies that inhere in crossover networks and voice coils of drivers can be compensated. This feature adapts a given dispersion system to a variety of drivers and crossover networks and is useful to practitioners desiring to experiment with various drivers and crossover designs to further advance the art.

A final object of this invention is to make the dispersion system available as a separate structural unit which can be incorporated into the design of many otherwise conventional loudspeaker systems with different types of enclosures for the enhancement of the essentially non-directional sound waves.

SUMMARY OF THE INVENTION

The present invention is akin to prior art in that it is a dispersion system for directional sound waves comprising a plurality drivers of conventional dynamic design which are assigned adjacent bands of the audio spectrum, which fire vertically, which face reflecting surfaces of conic reflectors, the drivers and reflectors being mounted on supporting means which are maintained in position by spacing means in a vertical alignment about a vertical axis so that directional sound waves are dispersed outwardly 360 degrees about the vertical axis.

The present invention improves prior art by elimnating substantially all of the design defects of prior art which inhibit the undisturbed reflection of directional sound waves directly into ambient air thereby eliminating the many sources of distortion introduced by these design defects of prior art.

Further improvement is achieved by establishing a vertical separation of effective acoustic centers that approximates or is less than that of well designed frontal-firing louspeakers so that the vertical limitations of the "listening window" of coherent sound will meet or exceed present industry standards. Specifically this improves the vertical spread of coherent sound produced by known examples of prior art by approximately 50 percent to over 500 percent.

This invention further improves prior art by eliminating concave reflecting surfaces which focus reflected sound waves along parallel lines, restricting dispersion in vertical planes and encouraging sound wave interferences.

Preferred embodiments of this invention further improve prior art by the use of reflectors having reflecting surfaces that define true geometric cones. This feature, cooperating with the vertical separation of effective acoustic centers as mentioned above, results in even dispersion of directional sound waves in both horizontal and vertical planes and is believed to be state of the art in point-source omnidirectional sound by multiway loudspeakers.

The invention also features an option which provides means for adjusting the relative distances in the spaced relationships of the apexes of reflectors and the acoustic centers of facing drivers thereby providing advantages already mentioned for the practitioner who desires to advance the art.

Finally, this invention features supporting means for drivers and reflectors and spacing means that are independent of a loudspeaker enclosure. This improvement makes it possible to adapt the invention to a variety of loudspeaker enclosure systems for reproducing the essentially non-directional sound waves that require no dispersing system. It also enables owners of presently existing loudspeakers to convert them to point-source omnidirectional systems without adding greatly to their cost.

The invention and it objects and advantages will be better understood by a consideration of the accompanying drawings and their descriptions which follow.

DETAILED DESCRIPTION OF THE DRAWINGS

Figure 1:
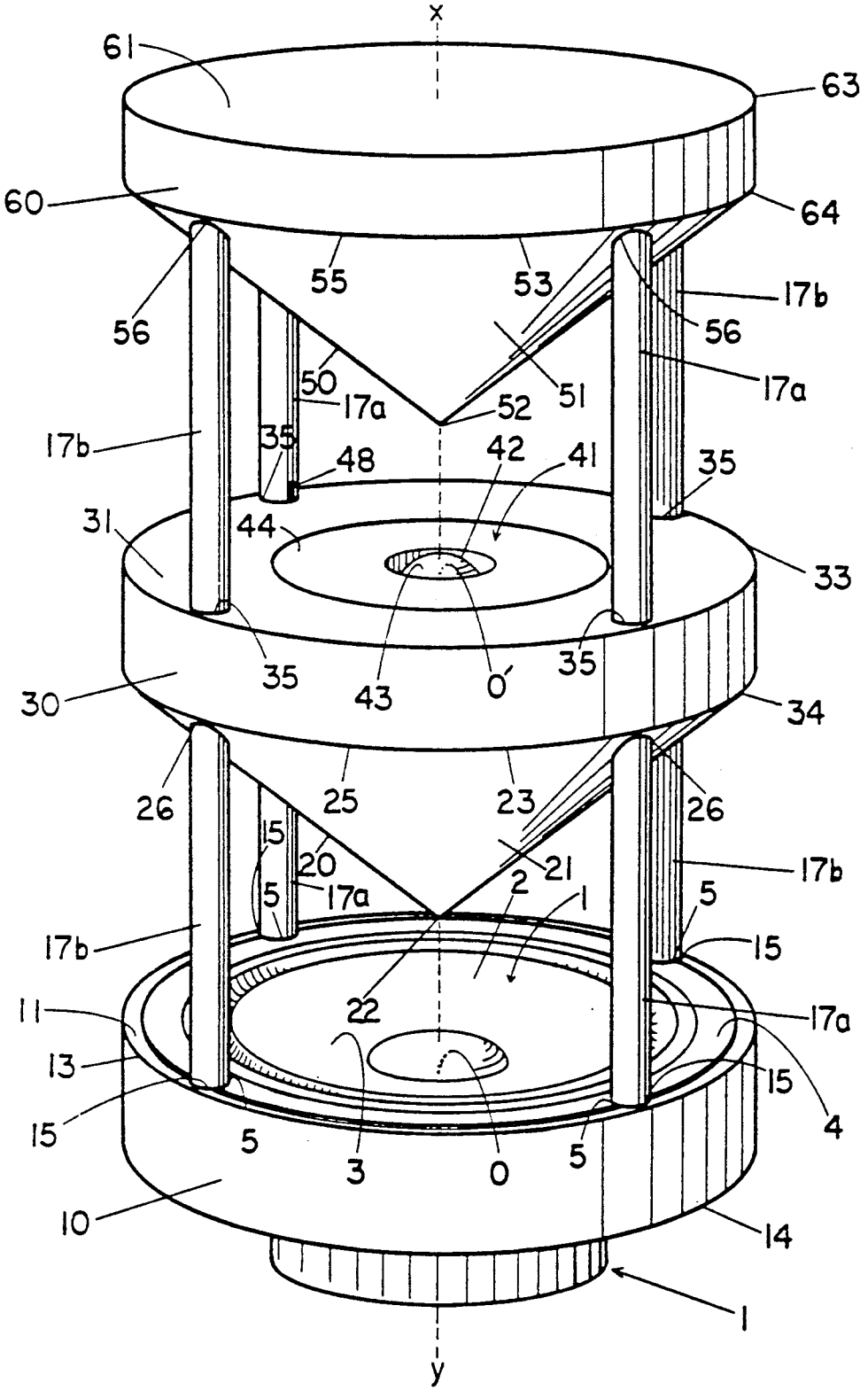
FIG. 1 is a perspective view of a preferred embodiment.

FIG. 1 shows woofer/midrange driver 1 mounted across centered opening 16 (not shown) of supporting means 10, mounting flange 4 being attached to mounting surface 11 so that the front side 3 of diaphragm 2 is upward and driver 1 faces reflecting surface 21 of reflector 20. Reflecting surface 21 is defined by apex 22 and base 23 of reflector 20. Two cylindrical spacers 17*a* and two cylindrical spacers 17*b* extend downward through four circular openings 5 in mounting flange 4 the lower extremities of spacers 17*a* and 17*b* seated in four cylindrical recesses 15 (not shown) in supporting means 10. Spacers 17*a* and 17*b* extend upward through four cylindrical openings 26 in reflector 20 and continue through four corresponding openings 35 in supporting means 30. Spacers 17*a* and 17*b* continue upward through four cylindrical openings 56 in reflector 50. The upper extremities of spacers 17*a* and 17*b* are seated in four cylindrical recesses 65 (not shown) in supporting means 60. Supporting means 30 is maintained in position by the pressure of two resilient friction means 39 (not shown) against spacers 17*b*. Planar surface 24 (not shown) of base 23 of reflector 20 is attached to bottom mounting surface 32 (not shown) of supporting means 30. Circumferential edge 25 of base 23 coincides circumferential outer edge 34 of mounting surface 32 (not shown) of supporting means 30. Planar surface 54 (not shown) of base 53 of reflector 50 is attached to bottom mounting surface 62 (not shown) of supporting means 60. Circumferential edge 55 of base 53 coincides with circumferential outer edge of mounting surface 62 (not shown) of supporting means 60. Driver 41, reproducuing a band of frequencies above that reproduced by driver 1, is mounted across centered vertical opening 36 (not shown) of supporting means 30, mounting flange 44 fastened to top mounting surface 31 so that front side 43 of diaphragm 42 is upward and driver 41 faces reflecting surface 51 of reflector 50, reflecting surface 51 being defined by apex 52 and base 53 of reflector 50. Acoustic center O of driver 1 and acoustic center O' of driver 41 are indicated below the surface of diaphragms 2 and 42 respectively. Supporting means 10 and supporting means 30 are proximate to each other in a spaced relationship. Supporting means 30 and supporting means 60 are proximate to each other in a spaced relationship. Vertical axis x—y of the dispersion system, indicated by a dashed line, can be seen to intersect the geometric centers of diaphragms 2 and 42 and apexes 22 and 52. The diviation of the slopes of reflecting surfaces 21 and 51 off vertical axis x—y are constant, reflecting surfaces 21 and 51 being true geometric cones.

Reflecting surface 21 shields mounting surface 32 (not shown) from sound waves radiating off diaphragm 2 and reflecting surface 51 shields mounting surface 62 (not shown) from sound waves radiating off diaphragm 42. This shielding eliminates the possibility of said mounting surfaces reflecting sound waves across the soundpath of sound waves reflected off reflecting surfaces 21 and 51 and eliminates distortion from sound wave interferences resulting therefrom. This shielding also eliminates the possibility of distortion from standing wave activity between opposed parallel planar mounting surfaces 11 and 32 respectively of proximate supporting means 10 and 30 and, similarly, for opposed parallel mounting surfaces 31 and 62 respectively of proximate supporting means 30 and 60.

There is a spaced relationship of acoustic centers O and O' with apexes 22 and 52 respectively which assures that directional sound waves reflected off reflecting surfaces 21 and 51 respectively are not reflected back upon diaphragms 2 and 42 respectively. This feature eliminates coloration of midrange and high frequency sound waves which results from the absorption, on the part of diaphragms 2 and 42, of reflected sound energy and contributes significantly to accurate saound reproduction.

Continuing reference to FIG. 1, the slope of reflecting surface 21 cooperates with the spaced relationship of proximate supporting means 10 and 30 and the slope of reflecting surface 51 cooperates with the spaced relationship of proximate supporting means 30 and 60 so that midrange and high frequency sound waves radiating off diaphragms 2 and 42 are reflected substantially directly into ambient air. This feature eliminates interior space which encloses the sound path of midrange and high frequency soundwaves, said interior space would cause sound waves to be reflected across the path of other soundwaves resulting in interferences which distort sound reproduction.

Continuing reference to FIG. 1, since the sound rays of midrange and high frequency sound waves are directional, and since reflecting surfaces 21 and 51 describe essentially true geometric cones the midrange and high frequency sound waves radiating off diaphragms 2 and 42 and striking reflecting surfaces 21 and 51 are dispersed with even intensity in horizontal planes. And since these sound waves strike reflecting surfaces 21 and 51 with decreasing angles of incidence as the points of striking approach the perimetric edges 25 and 55 of bases 23 and 53, said sound waves are reflected at corresponding decreases in angles of reflection assuring even dispersion in vertical planes that include vertical axis x—y.

Continuing reference to FIG. 1, the distance across supporting means 10 approximates the distance across the mounting flange 4 of driver 1 minimizing diffractional losses across mounting surface 11. Perimetric edges 13 and 14 of supporting means 10, 33 and 34 of supporting means 30, 63 and 64 of supporting means 60, 25 of base 23 and 55 of base 53 are circumferential and essentially congruent. Mounting surface 32 is shielded from sound waves generated by driver 1, mounting surface 62 is shielded from sound waves generated by driver 41. Thus there are no exposed surfaces to reflect sound waves back across the sound path of directional sound waves reflecting off reflecting surfaces 21 and 51, eliminating a source of sound wave interferences that cause reinforcement of some sound frequencies and cancellation of others.

Continuing with FIG. 1, it can be seen that apex 22 does not extend into the space defined by the horizontal plane of mounting flange 4 and front surface 3 of diaphragm 2. Reflecting surfaces 21 and 51 define essentially true geometric cones having constant deviations off vertical axis x—y. And the slope of reflecting surface 21 cooperates with the spaced relationship of proximate supporting means 10 and 30, and the slope of reflecting surface 51 cooperates with the spaced relationship of proximate supporting means 30 and 60, so that directional sound waves generated by drivers 1 and 41 are reflected substantially directly into ambient air. These features are more clearly discernable in FIG. 6.

The absence of steeply concaved reflecting surfaces eliminates the loss of high frequency sound energy from multiple reflections of these short-wavelength sound waves when they must maneuver curved surfaces. Focusing of directional sound waves by steeply concave surfaces along parallel or converging lines in vertical planes, another source of sound wave interferences, would also occur. This same focusing also would significantly reduce dispersion in vertical planes.

The elimination of many sources of distortion and the even dispersion of directional sound waves directly into ambient air in both horizontal and vertical planes approaches true pointsource omnidirectional dispersion and represents a significant improvement in the acoustical performance of dispersion systems for multiway loudspeakers which disperse sound away from a central vertical axis over 360 degrees in horizontal planes.

The perspective of FIG. 1 prevents accurate measurement of the distance between apexes 22 and 52. In embodiments as shown, where drivers and reflectors alternate in the vertical alignment, this distance is the equivalent of the vertical separation of the effective acoustic centers of the dispersion system. This vertical separation approximates or is less than one-half the combined distance across the mounting flanges of drivers 1 and 41 and assures that the vertical spread in the listening area over which sound from the drivers is coherent is equal to or greater than the vertical spread of coherent sound from well designed frontal-firing multiway loudspeaker systems. This feature maintains the two acoustic centers as close together as practical and enhances the point-source nature of the sound reproduction of a loudspeaker system utilizing the dispersion system and contributes thereby to precise and stable imaging in stereo applications.

Continuing with FIG. 1, lateral openings 48 provides access to hollow interior portion 47 (not shown) of one of spacers 17*a* and make it possible for wiring connections to driver 26 to be concealed while at the same time permitting supporting means 30 to be moved up and down when external force is applied in order to alter the relative distances in the spaced relationship of acoustic center O and apex 22 and the spaced relationship of acoustic center O' and apex 52. This feature is shown in greater detail in the cross section drawing of FIG. 3.

Continuing with FIG. 1, the embodiment illustrated in FIG. 1 is an independent structural unit suitable for mounting on the top panel of several different types of loudspeaker enclosures designed to enhance the reproduction of bass frequencies of woofer/midrange driver 1 in a two-way loudspeaker system. The embodiment in FIG. 1 can be mounted on the top panel of woofer enclosure for a three-way loudspeaker system. A centered vertical opening can be added to supporting means 60 and a third driver, reproducing a band of frequencies above those reproduced by driver 41, mounted thereon with an additional reflector centered above it for a three-way loudspeaker system. Replacing driver 1 with a driver of similar diameter but reproducing only midrange fequencies provides the option of supporting the dispersion system on a small base and using a pair of same as midrange/high frequency sattelite speakers of a large speaker system for enhancing bass frequencies.

Figure 6:
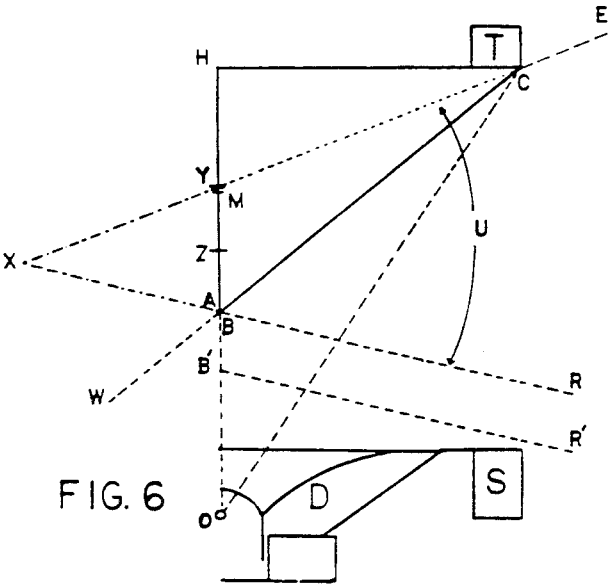
FIG. 6 is a diagram illustrating acoustical principles important to an understanding of the invention.

Additional factors affecting the acoustical performance of the dispersion system illustrated in FIG. 1 are discussed in the description of the cross sectional diagrammatic drawing of FIG. 6.

Figure 2:
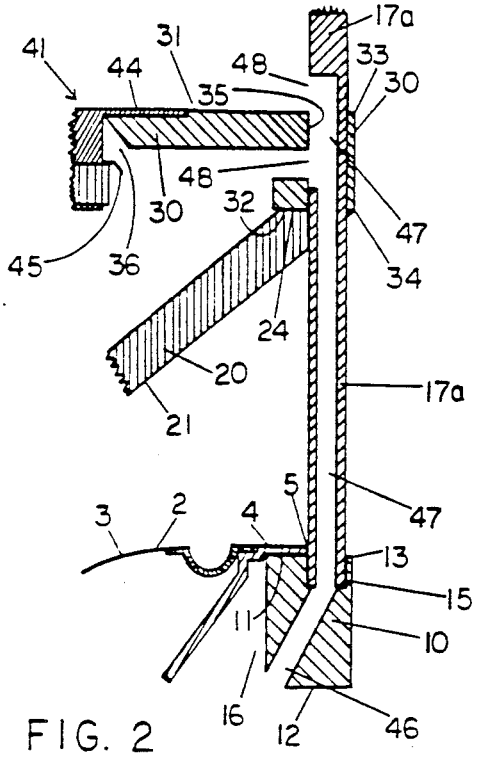
FIG. 2 shows the cross section of a portion of the embodiment shown in FIG. 1.

FIG. 2 shows driver 1 mounted across centered vertical opening 16 of supporting means 10. The lower extremity of one of spacers 17*a* is seated in cylindrical recess 15. Said spacer 17*a* extends upward through one of openings 5 in flange 4 of driver 1 and continues upward through opening 26 of reflector 20 and opening 35 of supporting means 30. A wiring pathway from terminal 45 of driver 41 is provided by lateral opening 48 in said spacer 17*a* providing access into hollow interior 47 of said spacer 17*a* which extends downward through hollow interior 47 into diagonal opening 46 of supporting means 10.

Figure 3:
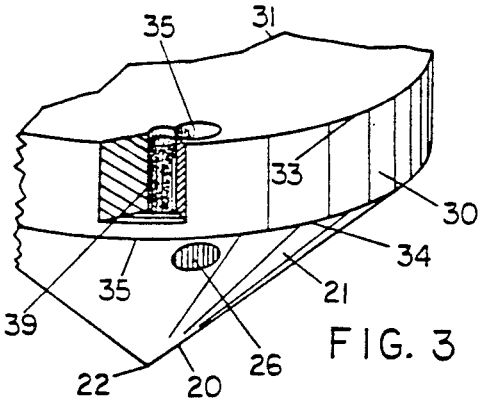
FIG. 3 is a perspective of a portion of the embodiment shown in FIG. 1.

FIG. 3 shows resilient friction means 39 installed in a cylindrical recess in supporting means 30. The cylindrical recess intersects cylindrical opening 35 in supporting means 30 so that a side portion of frictional means 39 protrudes into cylindrical opening 35. Frictional means 39 is compressed against the side of one of spacers 17*b* when said spacer extends through opening 35. The pressure exerted by two frictional means 39 against each of spacers 17*b* maintains supporting means 30 in place unless acted upon by external force.

Figure 4:
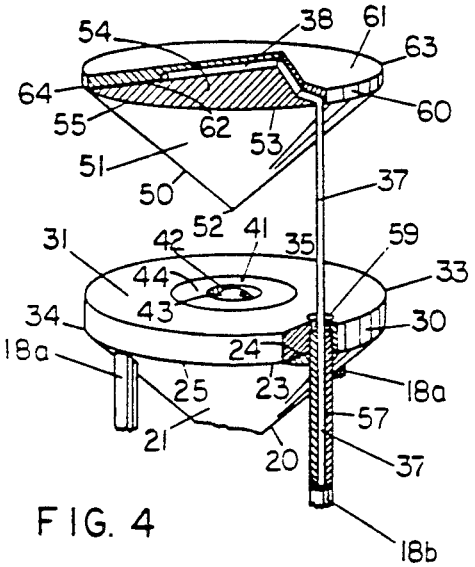
FIG. 4 is a perspective view of a modified version of the embodiment shown in FIG. 1.

FIG. 4 shows driver 41 mounted on supporting means 30 so that driver 41 faces reflecting surface 51 of reflector 50 as in FIG. 1. Vertical spacer 37 is a piece of heavy guage steel wire with a horizontal portion 38 extending into supporting means 60. Spacer 37 extends downward through small O-ring 59 which is secured in a recess in supporting means 30. Spacer 37 continues downward through hollow interior 57 of spacer 18*b*. O-ring 59 has a small inside diameter so that pressure is exerted against spacer 37 with sufficient force to maintain the assembly of spacer 37, supporting means 60 and reflector 50 in place when spacer 37 is raised to compensate for time and phase anomolies between drivers as previously discussed.

Figure 5:
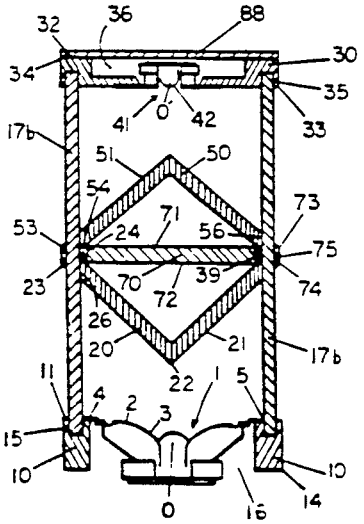
FIG. 5 is a cross-section of another modified version of the preferred embodiment shown in FIG. 1.

FIG. 5 shows a modified version of the embodiment shown in FIG. 1. Supporting means 30 is inverted and occupies the position that supporting means 60 occupies in FIG. 1. In addition, supporting means 30 has been modified in that cylindrical openings 35 have been replaced with cylindrical recesses 76 and supporting means 30 no longer has recesses to accomodate friction means 39. Supporting means 70 occupies the position that supporting means 30 occupies in FIG. 1. Top cover 88 covers centered vertical opening 36 of supporting means 30.

Continuing, planar surface 24 of base 23 of reflector 20 is attached to mounting surface 72 of supporting means 70 and planar surface 54 of base 53 of reflector 50 is attached to mounting surface 71 of supporting means 70. When two reflectors are positioned between drivers 1 and 41 in this manner the two effective acoustic centers 0 and 0' can be positioned somewhat closer together than they are in the embodiment shown in FIG. 1. provided the deviation of the slope of reflecting surface 21 and the deviation of the slope of reflecting surface 51 are both greater than 45 degrees. This results in a still larger vertical spread in the listening area over which soundwaves from drivers 1 and 41 respectively are coherent. On the other hand, when the deviations mentioned are relatively small the vertical separation of acoustic centers can be so far apart that the vertical spread is seriously shortened and coherent sound can be heard only in a horizontally narrow space in the listentening area.

Continuing reference to FIG. 5, resilient friction means 39 is secured in two recesses in supporting means 70, in the same manner illustrated with supporting means 30 in FIG. 2. so that retaining pressure is exerted against the sides of the two spacers 17*b*. Supporting means 70 can be moved up and down with the application of external pressure to adjust the relative distances in the spaced relationships of acoustic center O of driver 1 and apex 22 of reflector 20 and of acoustic center 0' of driver 41 and apex 52 of reflector 50 allowing thereby the correction of time and phase anomolies that may exist between driver 1 and driver 41. Not shown in the cross section drawing of FIG. 5 are the hollow interiors of the two spacers 17*a* extending the entire length of spacers 17*a*, the two lateral openings 48 and the two diagonal openings 46 through supporting means 10 which permit the wiring hookup of driver 41 to be hidden.

In FIG. 6, triangle AHC represents one half of a cross section of a conic reflector such as the one faced by driver 1 in FIG. 1 taken in the plane that includes the vertical axis of the dispersion system. Side AH represents the geometric height of the conic reflector and side AC represents the reflecting surface of the reflector from the apex at A to a point on the circumference of the base at C. The position of a driver having acoustic center represented by 0 is indicated by D and that of its supporting means is indicated by S in the diagram. The supporting means for the reflector represented by AHC is indicated by T.

Continuing reference to FIG. 6, sound energy that is most likely to be reflected back upon the diaphragm of a driver is that which is radiated vertically off the driver diaphragm from the direction of the acoustic center of the driver. Accordingly, the vertical portion of dashed line OBR represents a sound ray radiating vertically from O and striking AC at B immediately adjacent to apex A in a vertical plane that includes AH. BR, the continuation of dashed line OBR slanting downward to the right, represents the reflected portion of the sound ray. Apex A is elevated above the level of supporting means S so that the slope of AC and the spaced relationship of the acoustic center at O and apex A cooperate to assure that sound ray OR is not reflected back upon any part of the driver represented by D or of the supporting means represented by S, but is reflected directly into ambient air.

The downward slant BR indicates that the dispersion system represented can be positioned above the heads of listeners. B'R' represents the reflected portion of a sound ray OB'R' when the reflector represented by AHC is lowered. AB' indicates the distance that the reflector can be adjusted downward to compensate for time and phase anomolies before the adjustment would cause sound energy to be reflected on to S or any part of the driver represented by D.

Since the angle of reflection of directional sound waves equals the angle of incidence, simple geometry determines that angle HBC equals angle CBR and that angle HCB minus angle HBC gives the deflection off the horizontal of the reflected portion of OR. Since angle HBC is greater thatn angle HCA the deflection will be negative, or below the horizontal. If the slope of BC were 45 degrees, the deflection would be zero. This information enables a practitioner to avoid many of the acoustical deficiencies of prior art and to plan for the use of the invention with loudspeaker enclosures of various heights and horizontal dimensions.

FIG. 6 also shows OE, representing a sound ray, striking AC at C. Angle ECV, the angle of reflection is equal to angle OCW by definition, and is seen to be approximately one-half angle CAR. Angle U represents the dispersion of sound waves in vertical planes which include AH. Line segment AY represents the series of points on AH away from which the reflecting surface represented by AC disperses sound energy 360 degrees in horizontal planes. Point Z is the median point of AY and represents the effective acoustic center of sound waves dispersed by the reflecting surface represented by AC.

When horizontal cross sections of a reflecting surface define a circle of points equidistant from the vertical axis, the points away from which sound is reflected lie on the vertical axis in the region of the reflector's geometric height.

But when circles are not defined by horizontal cross sections of the reflecting surface, as in the case of a pyrimidal conic reflector, the points away from which sound is dispersed would lie partly on and partly proximately about the vertical axis in the region of the reflector's geometric height, their pattern and exact locations being determined by the contour of the reflecting surface. In either case the effective acoustic center will lie on the reflector's geometric height and the reflecting surface will reflect sound outwardly, away from each of said points on and about the vertical axis.

To locate the effective acoustic center on the geometric height of a reflector when the reflecting surface does not define a circle of points equidistant from the vertical axis it is necessary to draft a vertical cross section where the diviation from the vertical axis is the average of the least and greatest of the actual deviations.

Normally, the effective acoustic center is positioned on the reflector's geometric height between the apex and the midpoint of the geometric height. Exceptional conditions, such as a reflecting surface with a deviation from the vertical axis of less than 45 degrees, can determine that the effective acoustic center will be proximate to the apex.

In the design of dispersion systems where the drivers and reflectors alternate with each other in the vertical alignment the vertical separation of the effective acoustic centers will always be substantially equal to the distance between a point on the geometric height of one reflector and the corresponding point on the geometric height of an adjacent reflector. The distance between the apexes, visible and easily measured, is convenient for determining the separation.

However, in the case of a system where adjacent drivers face toward each other with facing reflectors between them, or where the drivers face away from each other with the reflectors before them, the location of the effective acoustic center of each reflector must be established in order to determine the vertical separation.

Finally, point X in FIG. 6 represents one of the two actual acoustic centers of the reflector in the plane of the sketch. Each acoustic center is the point at which geometric extensions of the lines representing the reflected portions of sound rays off the opposite side of the reflecting surface converge. Thus, an infinite number of actual acoustic centers of a true conic reflector exist forming a ring around the vertical axis of the dispersion system. With other generally conic reflecting surfaces the pattern of points around and about the geometric height or the vertical axis, will differ.

While the above descriptions contain specificities, these shoul not be construed as limitations on the scope of the invention but as exemplifications of specific preferred and optional embodiments thereof. Those skilled in the art will envision other possible variations within the scope and spirit of the invention. Accordingly, the scope of the invention should not be determined by the embodiments illustrated, but by the appended claims and their legal equivalents.

I claim:

1. An omnidirectional dispersion system for midrange and high frequency sound waves of multiway loudspeakers, said sound waves defining directional sound waves; said dispersion system comprising a plurality of drivers for generating said sound waves, a plurality of reflectors for dispersing said sound waves, a plurality of supporting means for mounting said drivers and said reflectors, and spacing means for vertically spacing apart said supporting means; each of said drivers having a diaphragm, said diaphragm having a planar perimetric outer edge and front and rear surfaces disposed about a geometric center, said diaphragm being vibrated by a voice coil, said voice coil having general dimensions of a thin-walled cylindrical tube with two opposed circular ends, said two ends lying substantially in parallel planes and having geometric centers, said voice coil having a longitudinal axis intersecting said geometric centers of said diaphragm and said two circular ends, one of said ends being a forward end of said voice coil, said forward end rigidly attached to said diaphragm so that said longitudinal axis is substantially perpendicular to a plane of said perimetric outer edge of said diaphragm, said rear surface of said diaphragm facing toward said voice coil, said diaphragm radiating sound waves off said front and rear surfaces thereof in opposite directions along and about a straight line that includes said longitudinal axis as a segment thereof, said straight line defining a firing axis of each of said drivers; said dispersion system utilizing only the radiation of sound waves off the front surface of said diaphragm; each of said drivers having a rigid frame for supporting said diaphragm and said voice coil, said sound waves generated from each of said drivers originating from and approximately about a point on said firing axis located approximately at said geometric center of said diaphragm, said point being an acoustic center of each of said drivers; said frame of each of said drivers having a forward part defined by a mounting flange, said mounting flange being a relatively flat outward extension of said frame in planes approximately parallel to the plane of said perimetric outer edge of said diaphragm; said mounting flange having a perimetric edge; there being defined a shortest distance across said mounting flange, said distance being a length of a shortest straight line segment intersecting said firing axis of each of said drivers and having ends thereof on said perimetric edge of said mounting flange; said shortest straight line segment defining a distance across each of said drivers; said drivers being reproducers of different bands of audio frequencies, at least one of said drivers being a reproducer of midrange frequencies, other of said drivers reproducing bands of frequencies above said band of frequencies reproduced by said at least one driver; each of said reflectors having a generally conic reflecting surface defined by an apex and a base; said base having a planar surface and a perimetric edge; each of said reflectors having a geometric height, said geometric height being substantially perpendicular to a plane of said base and extending from said plane to said apex, said conic reflecting surface of each of said reflectors disposed 360 degrees about said geometric height, said reflecting surface sloping from said apex to said perimetric edge of said base, said sloping defining a slope of said reflecting surface; said geometric height having a mid-point half-way between said apex and said plane of said base; each of said supporting means being of relatively flat one-piece construction, a top and bottom of each of said supporting means being vertically aligned planar surfaces in substantially horizontal planes, said planar surfaces being mounting surfaces; said mounting surfaces of each of said supporting means having substantially congruent perimetric outer edges and geometric centers; each of said supporting means having a continuous side surface, said side surface connecting said mounting surfaces at the perimetric outer edges of said mounting surfaces; each of said supporting means for mounting said drivers having a centered vertical opening intersecting a plane of each of said mounting surfaces, said openings accomodating a passage of rearward portions of one of said drivers when said one driver is mounted on one of said supporting means; there being defined a distance across each of said supporting means, said distance being a length of a shortest straight line segment intersecting a geometric center of one of said mounting surfaces and having ends thereof on a perimetric outer edge of said one mounting surface; each of said drivers being mounted across said opening of one of said supporting means for mounting said drivers, said mounting flange of each of said drivers being attached to one of said mounting surfaces of one of said supporting means for mounting said drivers; each of said reflectors being mounted on one of said supporting means, said planar surface of said base of each of said reflectors being attached to one of said mounting surfaces of one of said supporting means; said spacing means spacing apart said supporting means so that said drivers and said reflectors are positioned in a substantially vertical alignment wherein any two of said supporting means adjacent to one another define proximate supporting means, any two consecutively aligned drivers define proximate drivers, and any two consecutively mounted reflectors define proximate reflectors; a total distance across said proximate drivers defined by a combination of the distance across said proximate drivers; said vertical alignment being such that the firing axis of each of said drivers and the geometric height of each of said reflectors are substantially segments of a straight line, said straight line substantially coinciding with a vertical axis of said dispersion system; said alignment being such that each of said drivers faces the reflecting surface of one of said reflectors; said proximate drivers being reproducers of adjacent bands of audio frequencies; said vertical alignment being such that said proximate supporting means are in a spaced relationship, and such that the apex of the reflecting surface of each of said reflectors and the acoustic center of a facing driver are in a spaced relationship; and said alignment being such that said reflecting surface of each of said reflectors disperses said directional sound waves away from said vertical axis of said dispersion system 360 degrees about said vertical axis in substantially horizontal planes; said sound waves radiating outwardly from points on and proximately about said vertical axis in the region of the geometric height of each of said reflectors, a median point of said points being on said geometric height and defining an effective acoustic center of the dispersion system; a straight line segment having ends thereof on said effective acoustic center of proximate reflectors defining a vertical separation of said effective acoustic centers associated with said proximate reflectors; wherein the improvement comprises:

said perimetric edge of said base of each of said reflectors that substantially coincides with said perimetric outer edge of one of said mounting surfaces of each of said supporting means upon which each of said reflectors is mounted, whereby said one mounting surface is substantially shielded from midrange and high frequency sound waves radiating off said diaphragm of a facing driver, and also eliminating thereby parallel planar surfaces partially enclosing the soundpath of said sound waves; and said slope of said reflecting surface of each of said reflectors that cooperate with the spaced relationship of said proximate supporting means so that said reflecting surface reflects directional sound waves directly into ambient air.

2. A sound dispersion system as in 1 wherein said distance across said supporting means for said at least one midrange frequency driver approximates said distance across said at least one midrange frequency driver.

3. A sound dispersion system as in 1 wherein in said vertical alignment there is a sequence in which said drivers and said reflectors are positioned, said drivers alternating with said reflectors in said sequence.

4. A sound dispersion system as in 1 wherein two of said drivers face toward each other, and wherein between said two drivers at least one of said reflectors is mounted in a facing relationship.

5. A sound dispersion system as in 1 wherein means are provided for adjusting said spaced relationship of the apex of said reflecting surface of each of said reflectors and the acoustic center of a facing driver.

6. A sound dispersion system as in 1 wherein said perimetric edge of said base of each of said reflectors and said perimetric outer edges of said mounting surfaces of each of said supporting means are substantially congruent.

7. A sound dispersion system as in 1 wherein said slope of said reflecting surface of each of said reflectors has a relatively constant deviation from the geometric height of each of said reflectors so that a steeply concaved reflecting surface is eliminated; whereby energy absorbing multiple reflections of high frequency sound waves is avoided, whereby focusing of directional sound waves in vertical planes is avoided thereby eliminating sound wave interferences, whereby directional sound waves are reflected at decreasing angles of reflection as points of reflection approach said base of each of said reflectors thereby maintaining substantial dispersion of said sound waves in vertical planes.

8. A sound dispersion system as in 1 wherein said spacing means separate said supporting means so that a spaced relationship exists between said proximate reflectors such that said vertical separation of said effective acoustic centers is substantially equal to one-half of a combined distance across said proximate drivers facing said reflecting surfaces of said proximate reflectors.

9. A sound dispersion system as in 8 wherein in said vertical alignment there is a sequence in which said drivers and said reflectors are positioned, said drivers alternating with said reflectors in said sequence.

10. A sound dispersion system as in 9 wherein two of said drivers face toward each other and wherein between said two drivers at least one of said reflectors is mounted in a facing relationship.

11. A sound dispersion system as in 9 wherein said perimetric outer edges of the mounting surfaces of each of said supporting means and the perimetric edge of the base of each of said reflectors are substantially congruent.

12. A sound dispersing system as in 10 wherein the distance across each of said supporting means approximates the distance across said at least one driver reproducing midrange frequencies.

13. A sound dispersion system as in 10 wherein the spaced relationship of the apex of the reflecting surface of each of said reflectors and the acoustic center of a facing driver is such that the apex of each of said reflectors is outside a space defined by a horizontal plane of the mounting flange of a facing driver and the front surface of a conic diaphragm of said facing driver.

14. A sound dispersion system as in 10 wherein said slope of said reflecting surface of each of said reflectors has a relatively constant deviation from the geometric height of each of said reflectors so that a steeply concaved reflecting surface is eliminated; whereby energy absorbing multiple reflections of high frequency sound waves is avoided; whereby focusing of directional sound waves in vertical planes is avoided thereby eliminating sound wave interferences; whereby directional sound waves are reflected at decreasing angles of reflection as points of reflection approach said base of each of said reflectors thereby maintaining substantial dispersion of said sound waves in vertical planes.

15. A sound dispersion system as in 8 wherein means are provided to alter the spaced relationship of the apex of each of said reflectors and the acoustic center of a facing driver.

16. A sound dispersion system as in 21 wherein said perimetric outer edges of said mounting surfaces of each of said supporting means and said perimetric edge of the base of each of said reflectors are essentially circumferential edges, said circumferential edges being substantially congruent; said distance across each of said supporting means represented by a straight line segment in a plane of one of said mounting surfaces and having ends thereof on said circunferential edge of said one mounting surface; said distance across said supporting means approximating said distance across said at least one midrange driver; said perimetric outer edge of said diaphragm of each of said drivers being essentially circumferential: said slope of the reflecting surface of each of said reflectors having a substantially constant deviation from said geometric height of each of said reflectors, said apex and said base of each of said reflectors defining a reflecting surface that is a substantially true geometric cone so that a progressive decrease in angles of reflection occurs as directional sound waves strike said reflecting surface closer and closer to the base thereof, said progressive decrease in angles of reflection being substantially proportional to a progressive decrease in corresponding angles of incidence of said sound waves; the apex of each of said reflectors being outside a space defined by a horizontal plane of the mounting flange of a facing driver and a front surface of a conic diaphragm of said facing driver; said slope of the reflecting surface of each of said reflectors cooperating with said spaced relationship of said proximate supporting means so that directional sound waves generated by a facing driver are reflected substantially directly into ambient air; said conic reflecting surface of each of said proximate reflectors dispersing said directional sound waves away from a series of points on the geometric height of each of said proximate reflectors with essentially even intensity 360 degrees about said vertical axis in horizontal planes and with essentially even intensity in vertical planes that include said vertical axis, whereby dispersion of directional sound waves by said dispersion system for multiway loudspeakers approximates point-source omnidirectional sound.

17. A sound dispersion system as in 9 wherein in said vertical alignment there is a sequence in which said drivers and said reflectors are positioned, said drivers alternating with said reflectors in said sequence.

18. A sound dispersion system as is 9 wherein two of said drivers face toward each other, and wherein between said two drivers two of said reflectors are mounted in a facing relationship; the slope of each of said two reflectors having a deviation from said vertical axis of at least 45 degrees.

19. A sound dispersion system as in 9 wherein means are provided to alter the spaced relationship of the apex of each of said reflectors and the acoustic center of a facing driver.

20. A sound dispersion system as in 1 wherein the spaced relationship of the apex of the reflecting surface of each of said reflectors and the acoustic center of a facing driver is such the apex of each of said reflectors lies outside a space defined by a horizontal plane of the mounting flange of a facing driver and the front surface of a conic diaphragm of said facing driver.

* * * * *